US007598917B2

(12) United States Patent
Chen

(10) Patent No.: US 7,598,917 B2
(45) Date of Patent: Oct. 6, 2009

(54) ANTENNA MODULE

(75) Inventor: Shuenn-Shyan Chen, Tao Yuan Shien (TW)

(73) Assignee: Quanta Computer Inc., Tao Yuan Shien (TW)

( * ) Notice: Subject to any disclaimer, the term of this patent is extended or adjusted under 35 U.S.C. 154(b) by 77 days.

(21) Appl. No.: 11/976,256

(22) Filed: Oct. 23, 2007

(65) Prior Publication Data

US 2009/0066594 A1 Mar. 12, 2009

(30) Foreign Application Priority Data

Sep. 7, 2007 (TW) ..... 96133498 A

(51) Int. Cl.
*H01Q 21/00* (2006.01)

(52) U.S. Cl. ..... 343/725; 343/728

(58) Field of Classification Search ..... 343/725, 343/726, 728, 729, 895

See application file for complete search history.

(56) References Cited

U.S. PATENT DOCUMENTS 5,317,327 A * 5/1994 Piole ..... 343/725
6,160,512 A * 12/2000 Desclos et al. ..... 343/700 MS
6,181,286 B1 * 1/2001 Roscoe et al. ..... 343/725
6,229,488 B1 * 5/2001 Lin et al. ..... 343/700 MS
6,859,181 B2 * 2/2005 Colburn et al. ..... 343/725

* cited by examiner

*Primary Examiner*—Hoang V Nguyen
(74) *Attorney, Agent, or Firm*—Rabin & Berdo, P.C.

(57) ABSTRACT

An antenna module including a ground plate, a first radiating body and a second radiating body is provided. The first radiating body is disposed above the ground plate for receiving or transmitting a first signal emitted from at least an artificial satellite. The second radiating body is disposed between the ground plate and the first radiating body for receiving or transmitting a second signal emitted from various directions.

23 Claims, 12 Drawing Sheets

Peak = 5.05 dBi, Avg. = 0.31 dBi.

Peak = 6.49 dBi, Avg. = 0.58 dBi.

Peak = 3.75 dBi, Avg. = -0.75 dBi.

Peak = 4.09 dBi, Avg. = -1.27 dBi.

ANTENNA MODULE

This application claims the benefit of Taiwan application Serial No. 096133498, filed Sep. 7, 2007, the subject matter of which is incorporated herein by reference.

BACKGROUND OF THE INVENTION

1. Field of the Invention

The invention relates in general to an antenna module, and more particularly to an antenna module capable of receiving or transmitting a signal emitted from an artificial satellite or from various directions.

2. Description of the Related Art

Along with the development of wireless telecommunication technology, electronic products are equipped with various communication functions. There are a large variety of wireless communication including GPS, RDS, DVB-T, DVB-H, 802.11a/b/g/n, WiMAX, 3G, GSM, GPRS, PHS, FM/AM, Zigee and Irda each having respective operating frequency band.

Wireless telecommunication technology receives or transmits signals of corresponding frequency band. While most radio frequency systems adopt multi-frequency bands, most antennas receive the signals of various frequencies by using multiple sets of independent antennas, not only increasing the complexity of the communication system but also reducing the efficiency in space utilization.

When two sets of antenna are combined to form a composite antenna, the interference between the two sets of antennas would severely affect the band width and radiation pattern of radio frequency or even impair the original function of the antennas.

As more and more complicated telecommunication types are incorporated in electronic devices, how to increase the frequency width and at the same time maintain excellent radiation pattern has become a challenge to be resolved.

SUMMARY OF THE INVENTION

The invention is directed to an antenna module capable of receiving or transmitting a signal emitted from an artificial satellite or from various directions through the incorporation of a first radiating body and a second radiating body.

According to a first aspect of the present invention, an antenna module including a ground plate, a first radiating body and a second radiating body is provided. The first radiating body is disposed above the ground plate for receiving or transmitting a first signal emitted from at least an artificial satellite. The second radiating body is disposed between the ground plate and the first radiating body for receiving or transmitting a second signal emitted from various directions.

The invention will become apparent from the following detailed description of the preferred but non-limiting embodiments. The following description is made with reference to the accompanying drawings.

DETAILED DESCRIPTION OF THE INVENTION

First Embodiment

Figure 1:
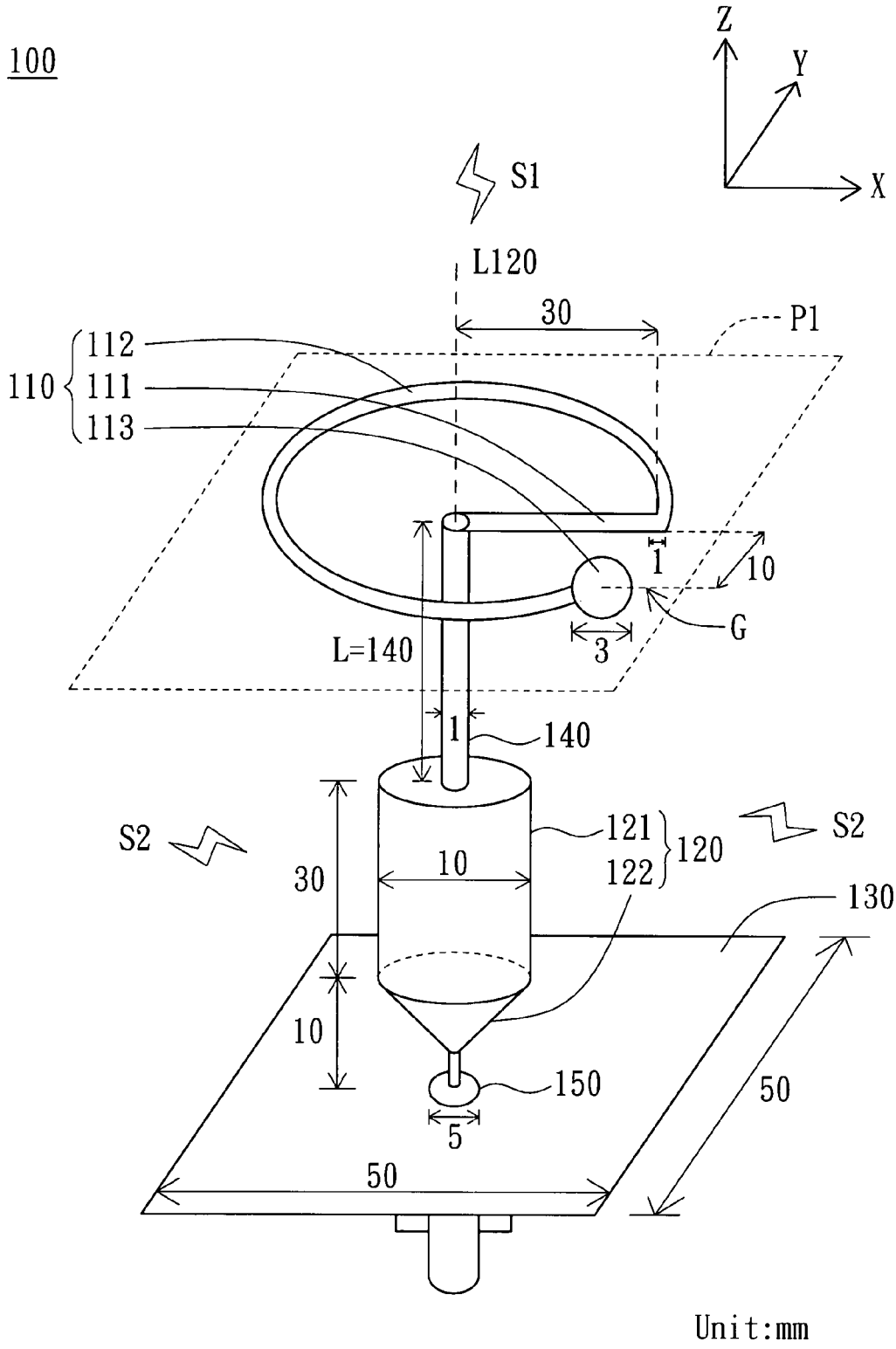
FIG. 1 is a perspective of an antenna module according to a first embodiment of the invention.

Referring to FIG. 1, a perspective of an antenna module 100 according to a first embodiment of the invention is shown. The antenna module 100 includes a ground plate 130, a first radiating body 110 and a second radiating body 120. The first radiating body 110 is disposed above the ground plate 130 for receiving or transmitting a first signal S1 emitted from at least an artificial satellite (not illustrated). The second radiating body 120 is disposed between the ground plate 130 and the first radiating body 110 for receiving or transmitting a second signal S2 emitted from various directions. The first radiating body 110 is disposed above the second radiating body 120 and is not interfered with by the second radiating body 120. Therefore, one antenna module 100 suffices to receive or transmit two different signals, and there is no need to install a dual-antenna structure, hence making the use of space more efficiently.

Besides, the first radiating body 110 resonates within a first frequency range, and the second radiating body 120 resonates within a second frequency range higher than the first frequency range. Therefore, one antenna module 100 functions within both the first frequency range and the second frequency range, further expanding the operating frequency bandwidth of the antenna module 100.

The first radiating body 110 and the second radiating body 120 are connected via a connecting rod 140. In the present embodiment of the invention, the first frequency range within which the first radiating body 110 resonates is 1575.42 MHz. In other words, the first radiating body 110, the connecting rod 140, the second radiating body 120 and the ground plate 130 form a global positioning system (GPS) antenna structure. The second frequency range within which the second radiating body 120 is 3.1 GHz~10 GHz. In otherwords, the second radiating body 120 and the ground plate 130 form an ultra-wideband (UWB) antenna structure. The GPS antenna structure and the UWB antenna structure share a feed-in point 150.

Preferably, the length L of the connecting rod 140 is greater than a half of the larger of the wavelength $\lambda_1$ of the first signal S1 and the wavelength $\lambda_2$ of the second signal S2. This relationship is expressed as formula (1):

$$L>\max(\lambda_1,\lambda_2)/2 \quad (1)$$

When the first radiating body 110 and the second radiating body 120 are kept at a certain distance, the field pattern of the first radiating body 110 and that of the second radiating body 120 will not interfere with each other. Through the operation of formula (1), as long as the length of the connecting rod 140 is larger than 100 mm, the interference between the first radiating body 110 and the second radiating body 120 will be avoided. In the present embodiment of the invention, the connecting rod 140 is exemplified by 140 mm.

The connecting rod 140 is substantially disposed along a central axis L120 of the second radiating body 120. The first radiating body 110 and the second radiating body 120 form a 360-degree symmetric structure with respect to the central axis L120, hence both having 360-degree radiation effect.

In the present embodiment of the invention, the first radiating body 110 includes a first radiating arm 111 and a second radiating arm 112. One end of the first radiating arm 111 is connected to the connecting rod 140, and the first radiating arm 111 is substantially perpendicular to the connecting rod 140. The second radiating arm 112 is connected to the other end of the first radiating arm 111, and winds around the other end of the first radiating arm 111 above the second radiating body 120. With the bending structure formed by the first radiating arm 111 and the second radiating arm 112, the first radiating body 110 reduces its shielding effect on the second radiating body 120 to assure the normal operation of both the first radiating body 110 and the second radiating body 120.

In the present embodiment of the invention, the length of the first radiating arm 111 is 30 mm. The second radiating arm 112 winds to from a circular structure around the joint between the first radiating arm 111 and the connecting rod 140. The length of the first radiating arm 111 is the radius of circular structure, and the length of the second radiating arm 112 is the circumference of the circular structure. By adjusting the length of the first radiating arm 111, the overall length of the first radiating body 110 is adjusted accordingly, so that the resonant frequency range of the first radiating body 110 is also adjusted. The current GPS signal emitted from the artificial satellite is within the resonant frequency of 1575.42 MHz. Therefore, as long as the resonant frequency range of the first radiating body 110 is adjusted as 1575.42 MHz, the GPS signal will be received.

Moreover, in the present embodiment of the invention, the diameters of the cross-section of the connecting rod 140, the first radiating arm and the second radiating arm 112 are both 1 mm. The connecting rod 140, the first radiating arm 111 and the second radiating arm 112 are directly formed by bending a metal rod whose diameter is 1 mm without going through complicated casting process. Such manufacturing method is simple and the material cost is cheap.

As indicated in FIG. 1, the circular structure is disposed on a radiating surface P1 substantially perpendicular to the connecting rod 140. The ground plate 130 is also substantially perpendicular to the connecting rod 140. When the antenna module 110 is placed on a desk surface substantially parallel to the horizon, the radiating surface P1 will be directed towards the sky. Thus; the first radiating body 110 receives the first signal S1 emitted from the artificial satellite.

Preferably, the first radiating body 110 further includes a radiating ball 113 disposed at a terminal end of the second radiating arm 112. The radiating ball 113 increases the radiating direction of the first radiating body 110. In the present embodiment of the invention, the diameter of the radiating ball 113 is 3 mm. The circular structure has a gap G whose length is 10 mm. The radiating ball 113 and the first radiating arm 111 are kept at a certain distance for avoiding the interference between the radiating ball 113 and the first radiating arm 111.

The second radiating body 120 includes a first radiating cylinder 121 and a second radiating cylinder 122. The first radiating cylinder 121 is substantially a circular column structure. The second radiating cylinder 122 is connected to the first radiating cylinder 121 and the ground plate 130, wherein the second radiating cylinder 122 is substantially a conical structure.

The diameter of the second radiating cylinder 122 diminishes from the first radiating cylinder 122 towards the ground plate 130 to form an inverted conical structure. In the present embodiment of the invention, the diameter of the first radiating cylinder 121 is 10 mm, the length of the first radiating cylinder 121 along the central axis L120 is 30 mm, and the length of the second radiating cylinder 122 along the central axis L120 is 10 mm. By adjusted the length of the first radiating cylinder 121 along the central axis L120 and the length of the second radiating cylinder 122 along the central axis L120, the resonant frequency range of the second radiating body 120 is adjusted accordingly.

Figure 2:
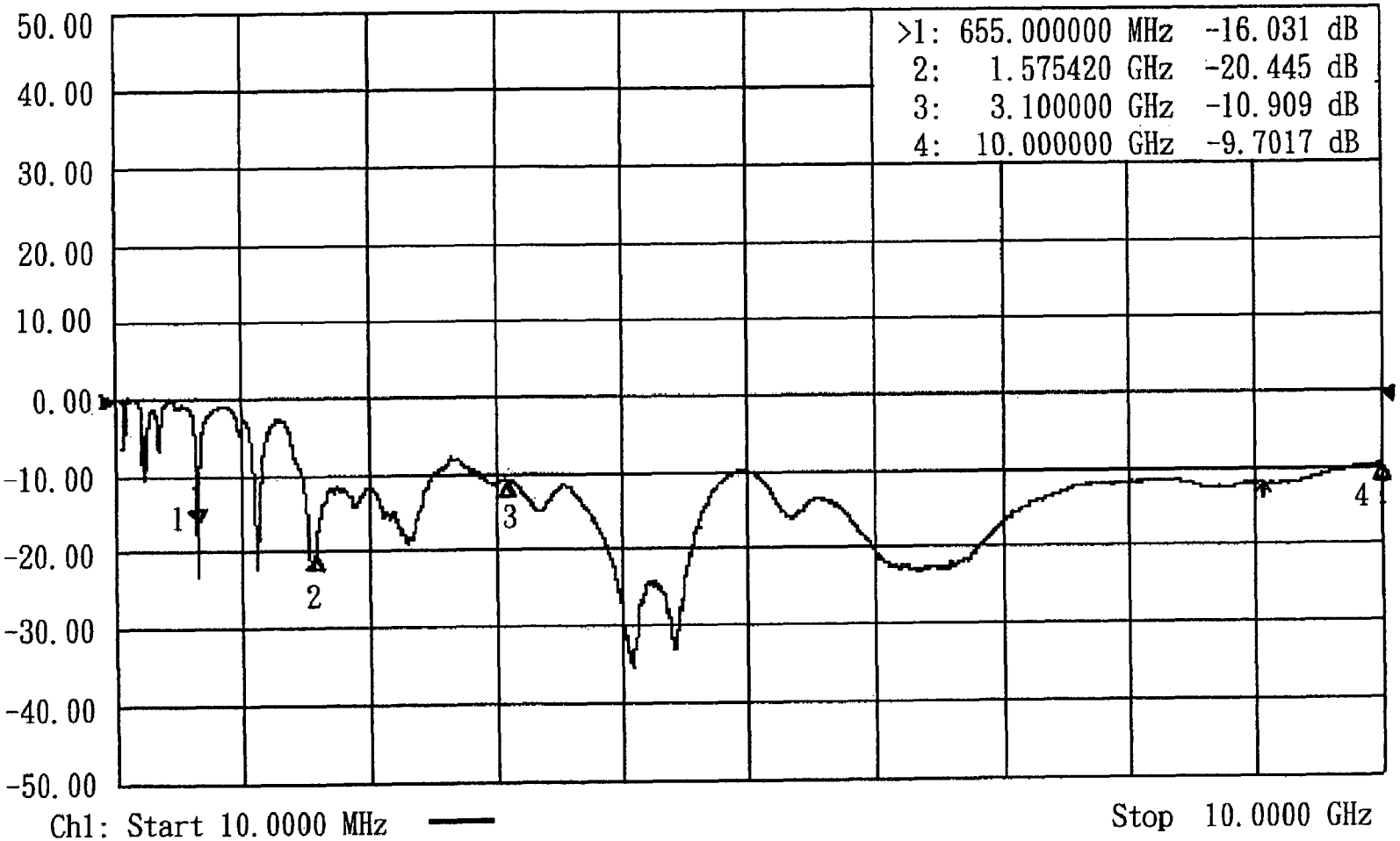
FIG. 2 is a return loss vs. frequency relationship diagram for the antenna module of FIG. 1.

Referring to FIG. 2, a return loss vs. frequency relationship diagram for the antenna module 100 of FIG. 1 is shown. As indicated in FIG. 2, the antenna module 100 operates normally at the frequency of 1575.42 MHz and within a frequency range of 3.1 GHz~10 GHz. This shows that the combination of the first radiating body 110 and the second radiating body 120 does not affect their resonant frequency range. That is, an antenna module 100 functions at the frequency of 1575.42 MHz and within a frequency range of 3.1 GHz~10 GHz as well.

Figure 3A:
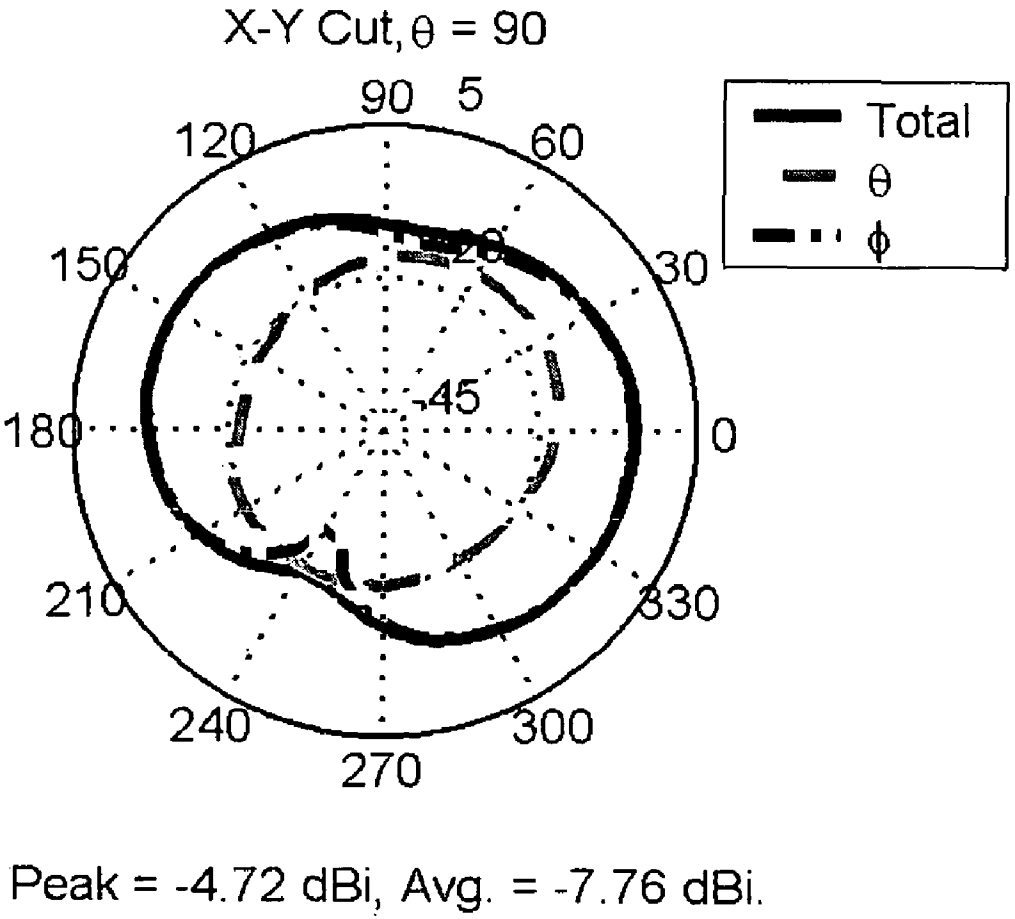
FIGS. 3A~3C are radiation patterns when the antenna module of FIG. 1 is operated at the frequency of 1575 MHz.
Figure 3C:
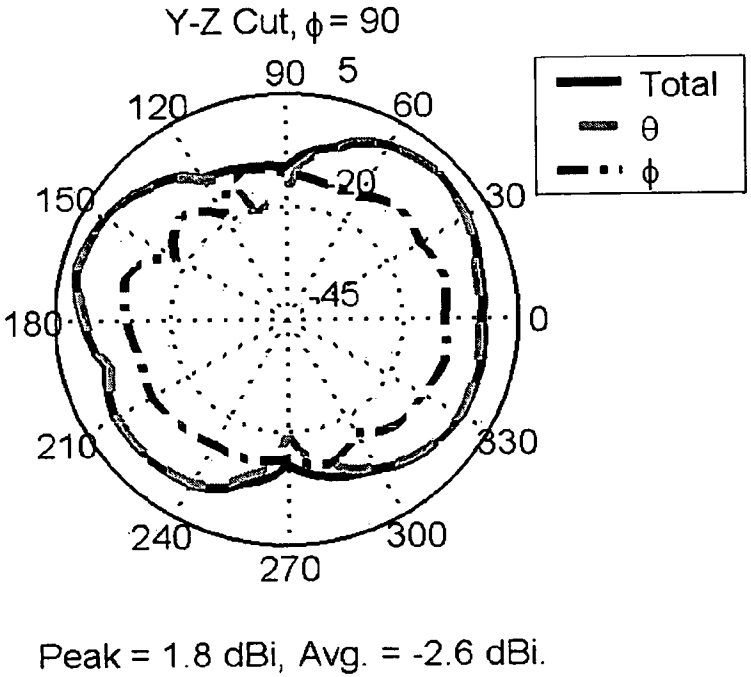
Figure 3B:
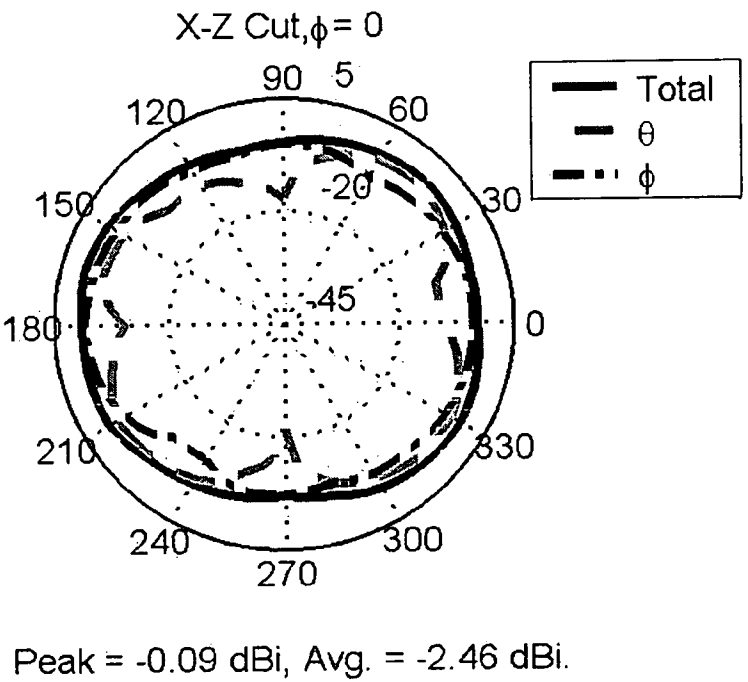

Referring to FIGS. 3A~3C, radiation patterns when the antenna module 100 of FIG. 1 is operated at the frequency of 1575 MHz are shown. As indicated in FIGS. 3A~3C, the antenna module 100 produces radiation patterns when operated at the frequency of 1575 MHz. Particularly, the antenna module 100 has a certain radiation effect towards the artificial satellite, and is not affected by the second radiating body 120.

Figure 4A:
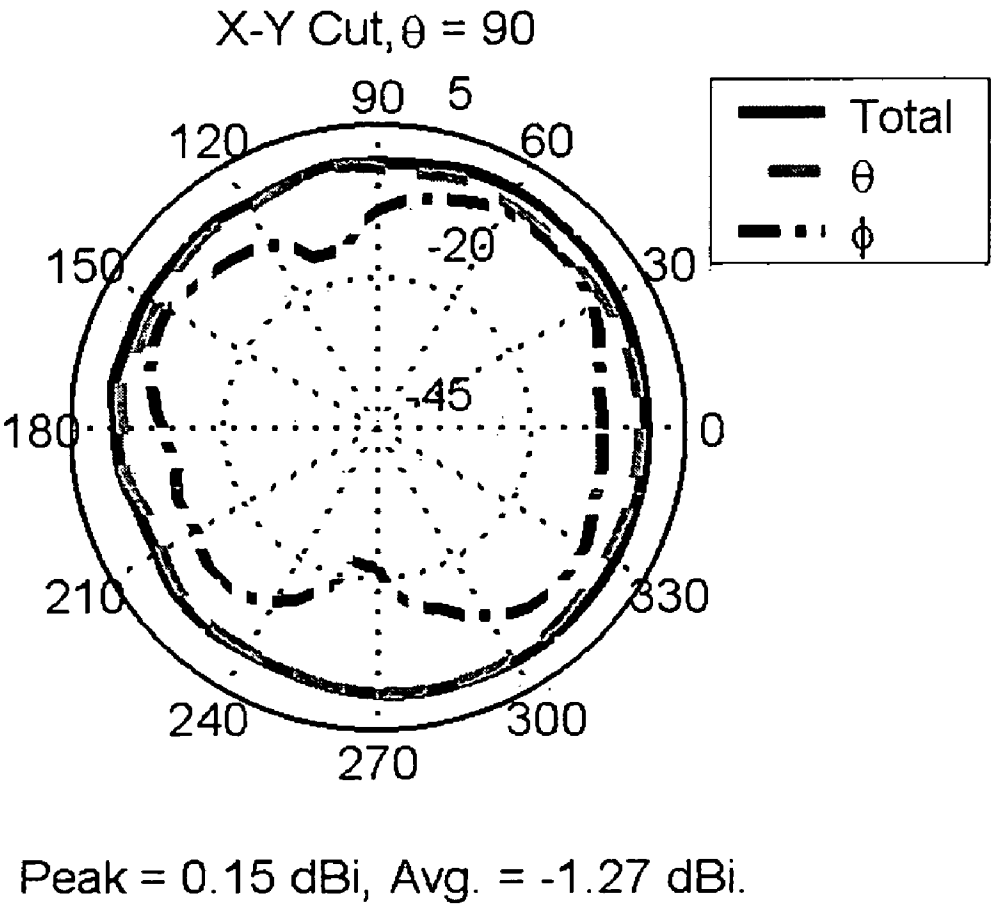
FIGS. 4A~4C are radiation patterns when the antenna module of FIG. 1 is operated at the frequency of 3432 MHz.
Figure 4C:
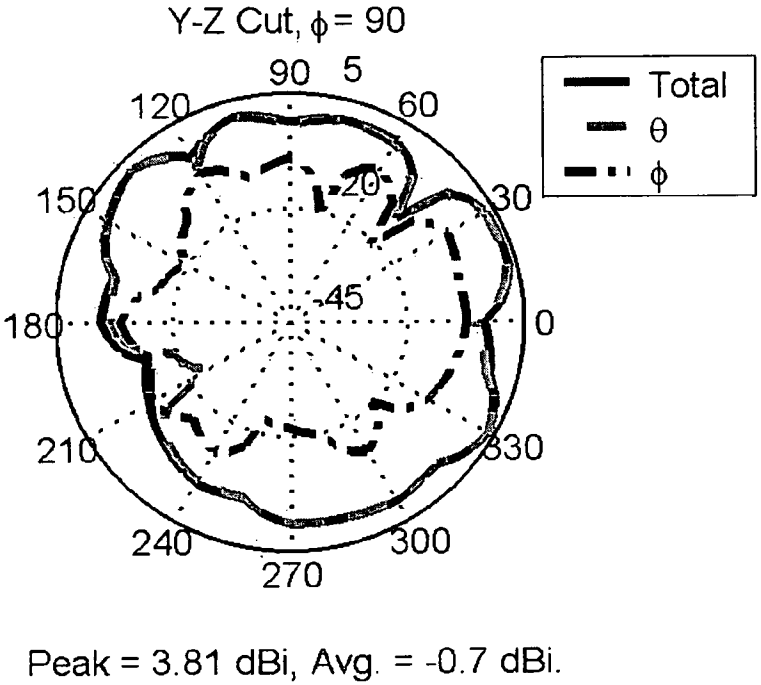
Figure 4B:
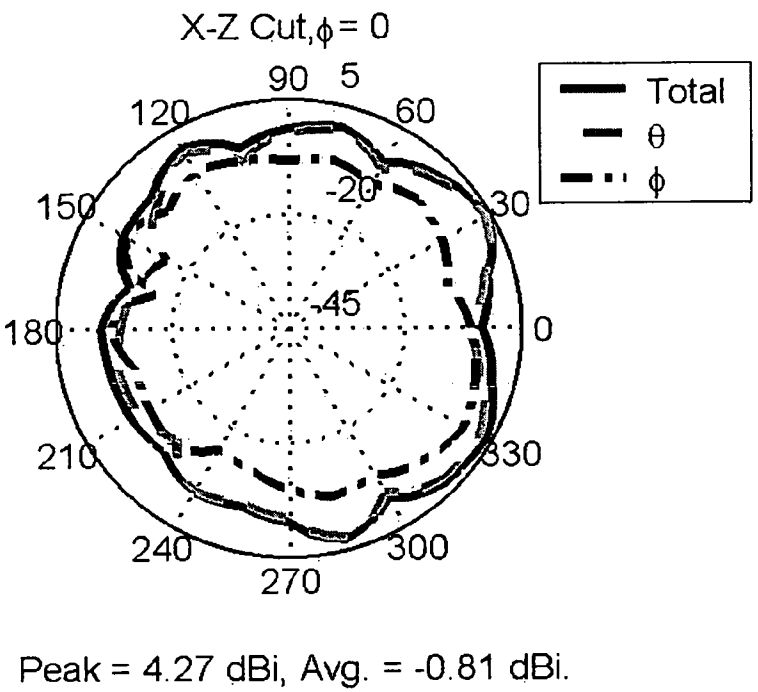
Figure 5A:
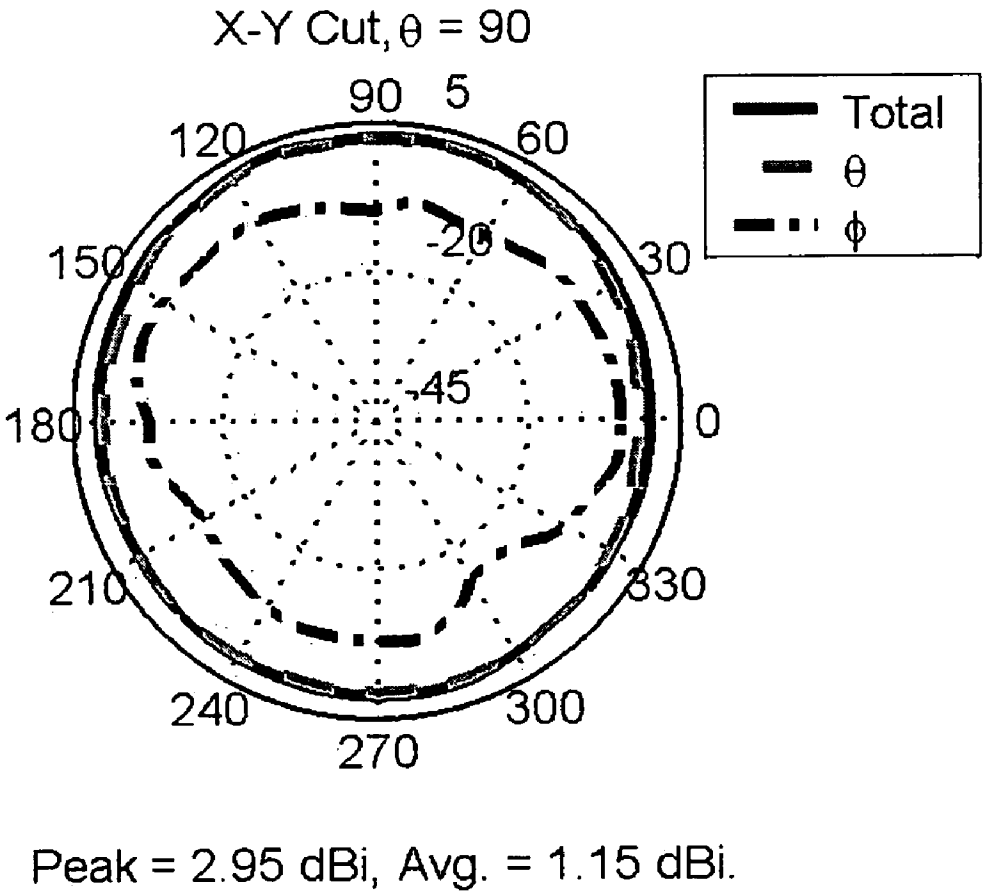
FIGS. 5A-5C are radiation patterns when the antenna module of FIG. 1 is operated at the frequency of 3960 MHz.
Figure 5C:
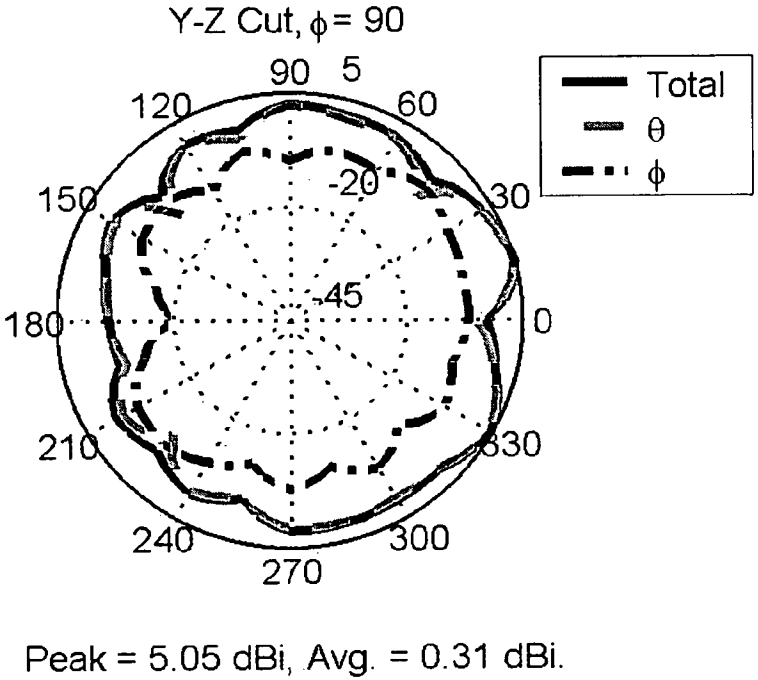
Figure 5B:
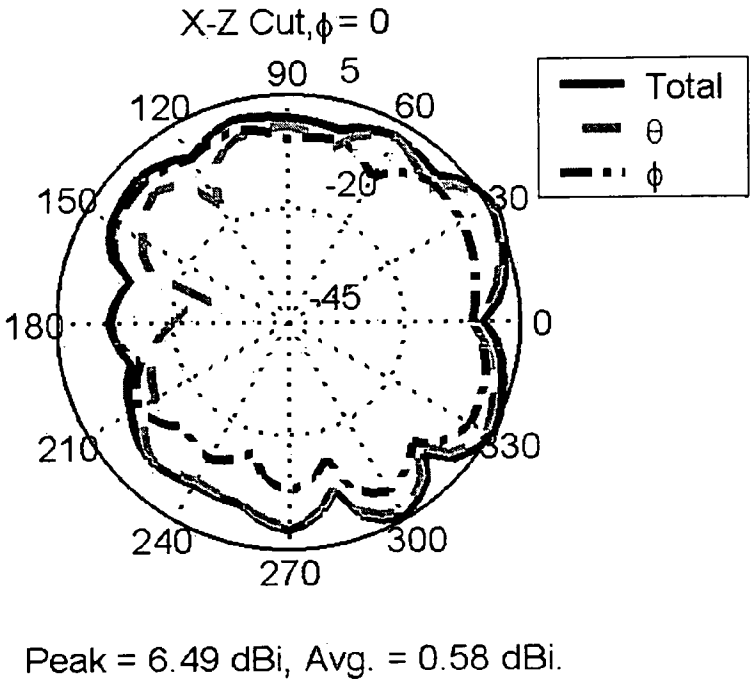
Figure 6A:
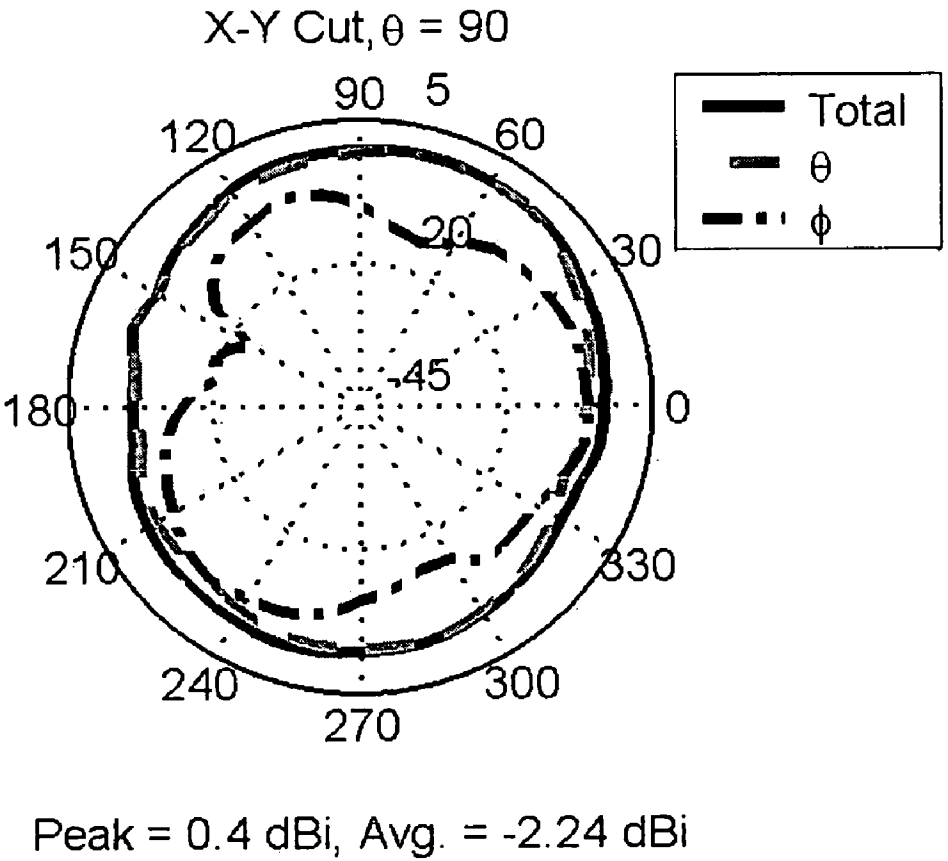
FIGS. 6A~6C are radiation patterns when the antenna module of FIG. 1 is operated at the frequency of 4488 MHz.
Figure 6C:
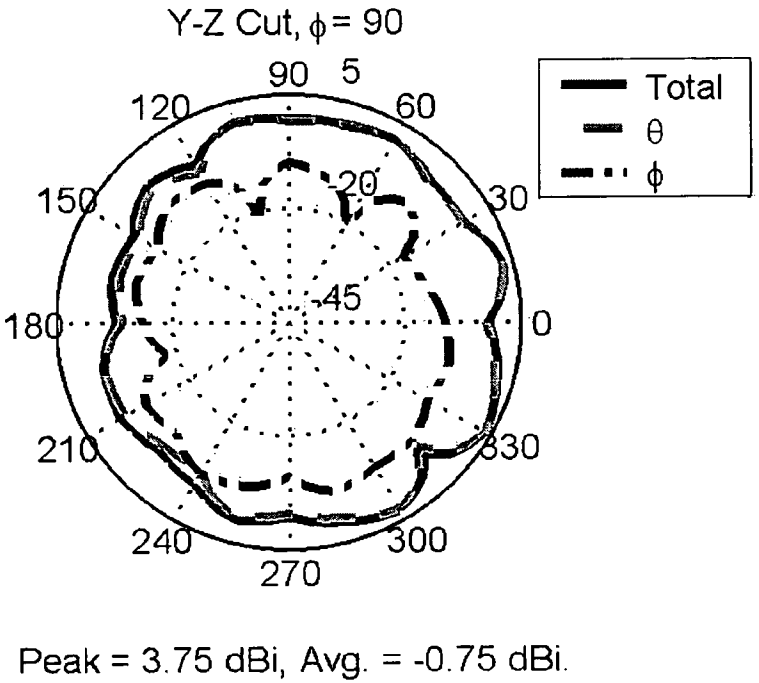
Figure 6B:
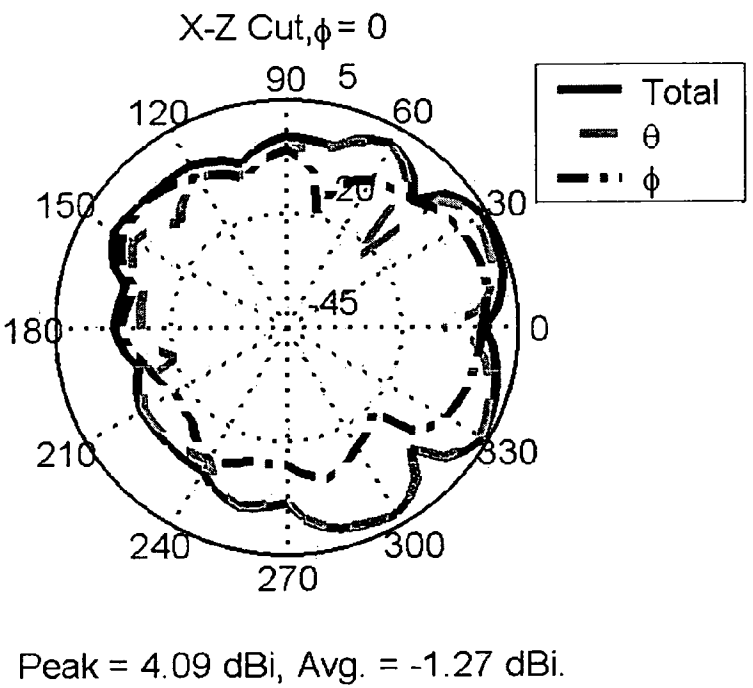

Referring to FIG. 4A~6C. FIGS. 4A~4C are radiation patterns when the antenna module 100 of FIG. 1 is operated at the frequency of 3432 MHz. FIGS. 5A~5C are radiation patterns when the antenna module 100 of FIG. 1 is operated at the frequency of 3960 MHz. FIGS. 6A~6C are radiation patterns when the antenna module 100 of FIG. 1 is operated at the frequency of 4488 MHz. As indicated in FIG. 4A~6C, the antenna module 100 has excellent radiation pattern when operated at the frequency of 3432 MHz, 3960 MHz and 4488 MHz. Therefore, it is concluded that the second radiating body 120 is not shielded by the first radiating body 110.

In the present embodiment of the invention, the dimension and structure of the antenna module are exemplified by the antenna module 100 of FIG. 1 but not for limiting the scope of protection of the invention. The dimension and structure of the antenna module 100 can be adjusted according to actual needs to achieve a suitable radiation pattern and a suitable resonant frequency range.

Second Embodiment

Figure 7:
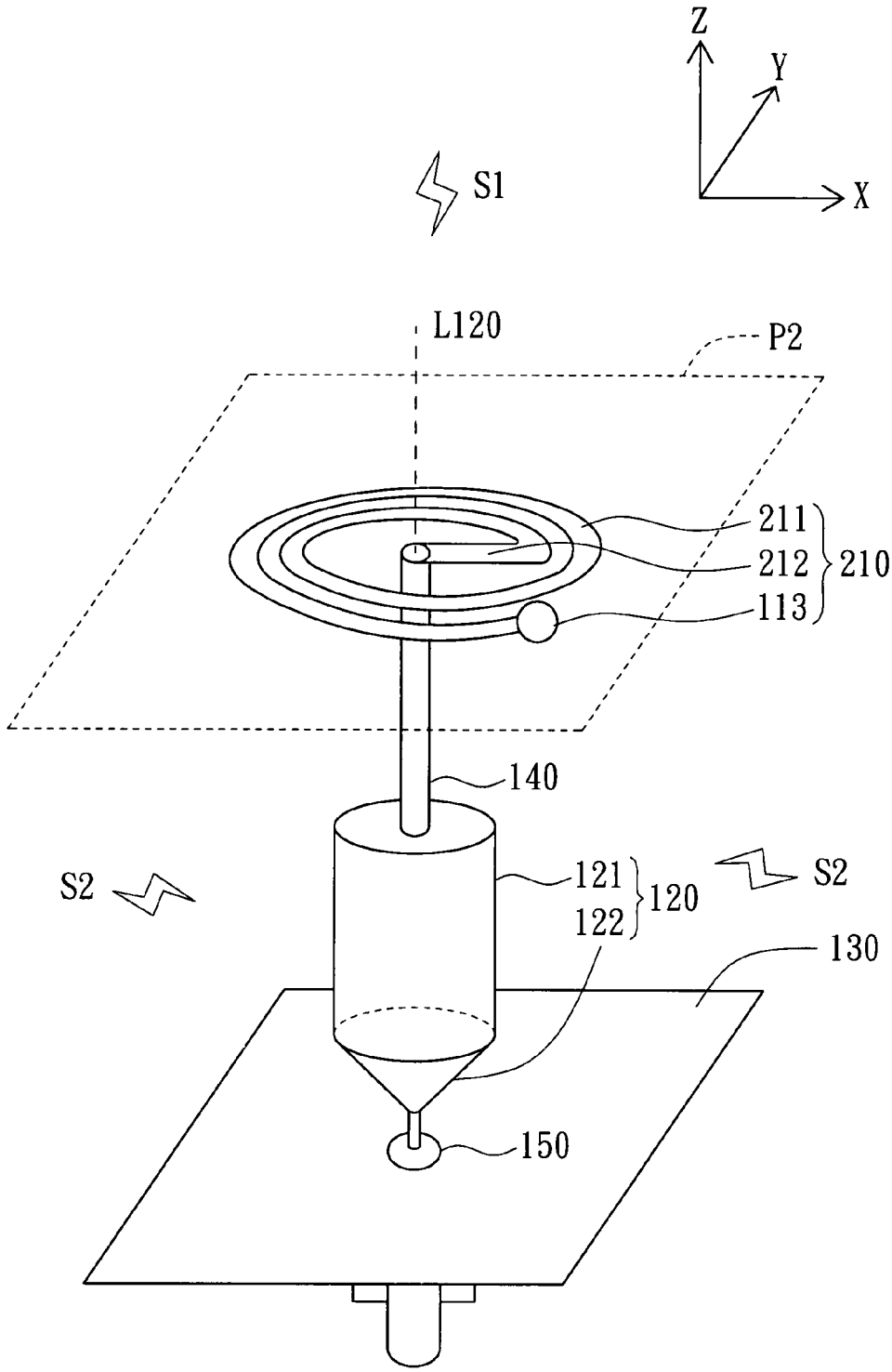
FIG. 7 is a perspective of an antenna module according to a second embodiment of the invention.

Referring to FIG. 7, a perspective of an antenna module 200 according to a second embodiment of the invention is shown. The antenna module 200 of the present embodiment of the invention differs with the antenna module 100 of the first embodiment in the structure of the first radiating body 210. As for other similarities, the same designations are used and are not repeated here.

As indicated in FIG. 7, the second radiating arm 212 of the first radiating body 210 gradually winds outwards to form a vortex structure substantially located on the same radiating surface P2, wherein the radiating surface P2 is substantially perpendicular to the connecting rod 140. When the antenna module 200 is placed on the desk surface substantially parallel to the horizon, the radiating surface P2 will be directed towards the sky. Thus, the first radiating body 210 receives a first signal emitted from the artificial satellite.

The second radiating arm 212 winds outwardly in two coils to form a vortex structure. By adjusting the length of the first radiating arm 211 and the number of coils formed by the second radiating arm 212 and the distance between the coils, the resonant frequency range of the first radiating body 210 is adjusted accordingly.

Besides, in the present embodiment of the invention, the second radiating body 120 is not shielded by the first radiating body 210 and still can receive the second signal S2.

Third Embodiment

Figure 8:
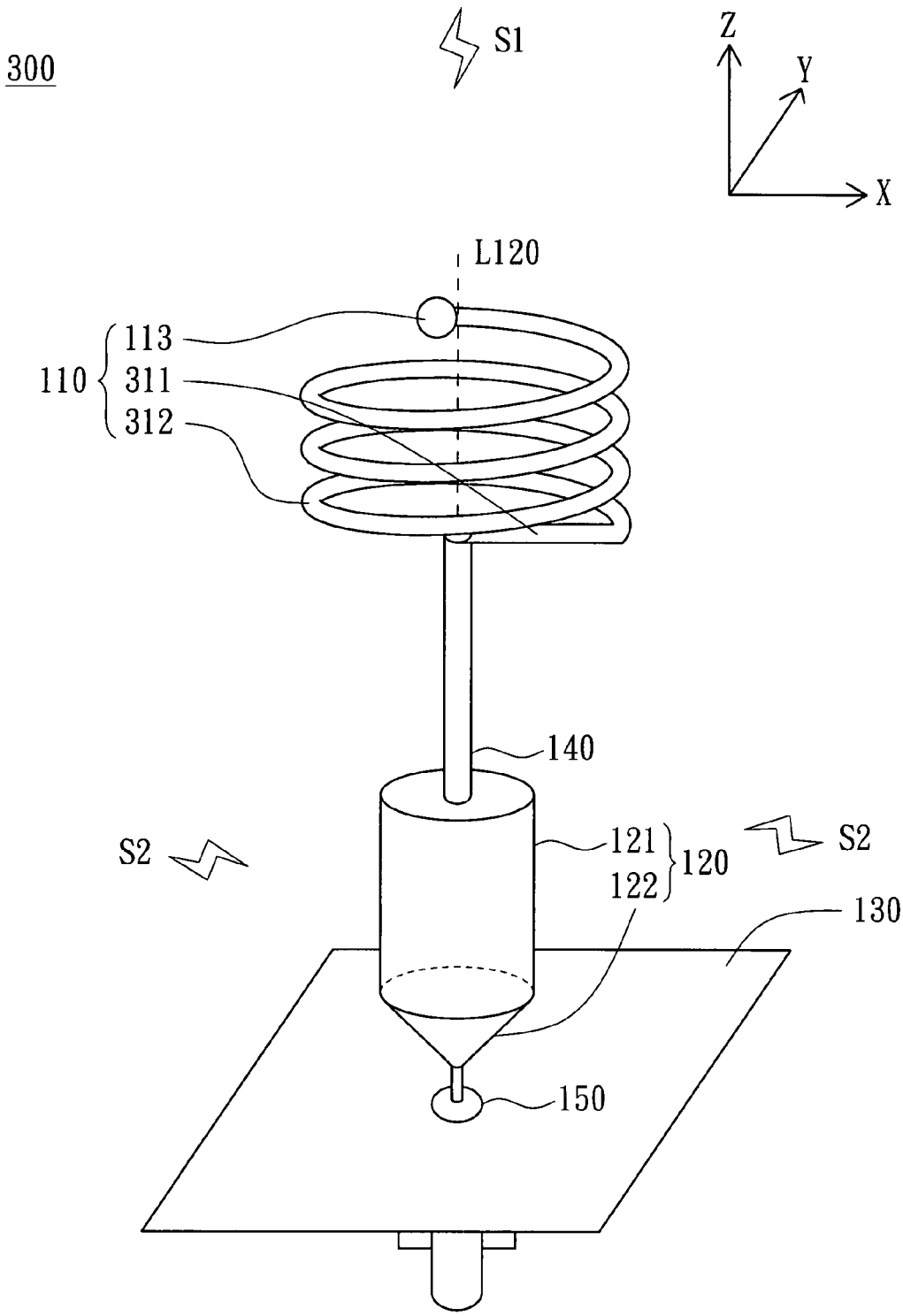
FIG. 8 is a perspective of an antenna module according to a third embodiment of the invention.

Referring to FIG. 8, a perspective of an antenna module 300 according to a third embodiment of the invention. The antenna module 300 of the present embodiment of the invention differs with the antenna module 100 of the first embodiment in the structure of the first radiating body 310. As for other similarities, the same designations are used and are not repeated here.

As indicated in FIG. 8, the second radiating arm 312 of the first radiating body 310 winds around the central axis L120 of the second radiating body 120 (ie. an extending axis of the connecting rod 140) to form a spiral structure. When the antenna module 300 is placed on the desk surface substantially parallel to the horizon, the central axis L120 is directed towards the sky. Thus, the first radiating body 310 receives the first signal S1 emitted from the artificial satellite.

The second radiating arm 312 winds upwards in a number of coils to form spiral structure. By adjusting the length of the first radiating arm 311 and the number of coils formed by the second radiating arm 312 and the distance between the coils, the resonant frequency range of the first radiating body 310 is adjusted accordingly.

Besides, in the present embodiment of the invention, the second radiating body 120 is not shielded by the first radiating body 310 and still can receive the second signal S2.

In the above embodiments, the dimension and structure of the antenna module are exemplified by the antenna module of FIG. 1, FIG. 7 and FIG. 8. However, anyone who is skilled in the technology of the invention will understand that the antenna module of the invention is not limited thereto. The dimension and structure of the antenna module can be adjusted according to actual needs. Any designs enabling the first radiating body to be disposed on the second radiating body for receiving the signal emitted from a artificial satellite in various directions are within the scope of protection of the invention.

The antenna module disclosed in the above embodiments of the invention, by combining the first radiating body and the second radiating body, has the following advantages:

1. As the first radiating body is disposed above the second radiating body, the first radiating body is not interfered with by the second radiating body. Therefore, one antenna module suffices to receive or transmit two different signals, and there is no need to install a dual-antenna structure, hence making the use of space more efficiently.

2. The first radiating body resonates within a first frequency range, and the second radiating body resonates within a second frequency range higher than the first frequency range. Therefore, the antenna module functions within both the first frequency range and the second frequency range, further expanding the operating frequency bandwidth of the antenna module.

3. The second radiating body and the first radiating body are kept at a certain distance, the field pattern of the first radiating body and that of the second radiating body will not interfere with each other.

4. The first radiating body and the second radiating body form a 360-degree symmetric structure with respect to a central axis, hence both having 360-degree radiation effect.

5. With the bending structure formed by the first radiating arm and the second radiating arm, the first radiating body reduces its shielding effect on the second radiating body to assure the normal operation of both the first radiating body and the second radiating body.

6. The diameters of the cross-section of the connecting rod, the first radiating arm and the second radiating arm are both 1 mm. The connecting rod, the first radiating arm and the second radiating arm are directly formed by bending a metal rod whose diameter is 1 mm without going through complicated casting process. Such manufacturing method is simple and the material cost is cheap.

7. The radiating surface of the first radiating body of the circular structure is substantially perpendicular to the connecting rod, the radiating surface of the first radiating body of the vortex structure is substantially perpendicular to the connecting rod, and the extending direction of the spiral first radiating body is parallel to the connecting rod. When the antenna module is placed on a desk surface substantially parallel to the horizon, the first radiating body will be directed towards the sky. Thus, the first radiating body receives the first signal emitted from the artificial satellite.

8. The radiating ball is capable of increasing the radiating bandwidth of the first radiating body. The radiating ball and the first radiating arm are kept at a certain distance for avoiding the interference between the radiating ball and the first radiating arm.

9. It is proved in the experiments that the antenna module functions at the frequency of 1575.42 MHz and within a frequency range of 3.1 GHz~10 GHz, and produces excellent radiation patterns. With the diversity of telecommunication products, the antenna modules disclosed in the above embodiments having wider operating frequency range and excellent radiation patterns are more competitive.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An antenna module, comprising:

a ground plate;

a first radiating body disposed above the ground plate for receiving or transmitting a first signal emitted from at least an artificial satellite;

a second radiating body disposed between the ground plate and the first radiating body for receiving or transmitting a second signal emitted from various directions; and a connecting rod for connecting the first radiating body and the second radiating body;

wherein the first radiating body, the connecting rod, the second radiating body and the ground plate form a global positioning system (GPS) antenna structure, the second radiating body and the ground plate form an ultra-wideband (UWB) antenna structure, and the length of the connecting rod is greater than half of the larger of the wavelength of the first signal and the wavelength of the second signal.

2. The antenna module according to claim 1, wherein the first radiating body resonates within a first frequency range and the second radiating body resonates within a second frequency range higher than the first frequency range.

3. The antenna module according to claim 1, wherein the length of the connecting rod is greater than 100 mm.

4. The antenna module according to claim 1, wherein the length of the connecting rod is 140 mm.

5. The antenna module according to claim 1, wherein the diameter of the cross-section of the connecting rod is 1 mm.

6. The antenna module according to claim 1, wherein the connecting rod is substantially disposed along a central axis of the second radiating body.

7. The antenna module according to claim 1, wherein the first radiating body comprises:

a first radiating arm whose one end is connected to the connecting rod, wherein the first radiating arm is substantially perpendicular to the connecting rod; and a second radiating arm connected to the other end of the first radiating arm, wherein the second radiating arm winds around the other end of the first radiating arm above the second radiating body.

8. The antenna module according to claim 7, wherein the length of the first radiating arm is 30 mm.

9. The antenna module according to claim 7, wherein the diameter of the cross-section of the first radiating arm and that of the second radiating arm are both 1 mm.

10. The antenna module according to claim 7, wherein the second radiating arm winds to form a circular structure.

11. The antenna module according to claim 10, wherein the circular structure is substantially located on a first plane substantially perpendicular to the connecting rod.

12. The antenna module according to claim 10, wherein the circular structure has a gap whose length is 10 mm.

13. The antenna module according to claim 7, wherein the second radiating arm winds outwardly to form a vortex structure.

14. The antenna module according to claim 13, wherein the vortex structure is substantially located on a second plane substantially perpendicular to the connecting rod.

15. The antenna module according to claim 13, wherein the second radiating arm winds outwardly in two coils to form the vortex structure.

16. The antenna module according to claim 7, wherein the second radiating arm winds around a extending axis of the connecting rod to from a spiral structure.

17. The antenna module according to claim 7, wherein the first radiating body further comprising:

a radiating ball disposed at a terminal end of the second radiating arm.

18. The antenna module according to claim 17, wherein the diameter of the radiating ball is 3 mm.

19. The antenna module according to claim 1, wherein the second radiating body comprises:

a first radiating cylinder being substantially a circular column structure; and a second radiating cylinder connected to the first radiating cylinder and the ground plate, wherein the second radiating cylinder is substantially a conical structure.

20. The antenna module according to claim 19, wherein the diameter of the second radiating cylinder gradually diminishes from the first radiating cylinder towards the ground plate.

21. The antenna module according to claim 19, wherein the diameter of the first radiating cylinder is 10 mm.

22. The antenna module according to claim 19, wherein the length of the first radiating cylinder along a central axis thereof is 30 mm.

23. The antenna module according to claim 19, wherein the length of the second radiating cylinder along a central axis thereof is 10 mm.

* * * * *